US005143771A

United States Patent [19]

Fourezon

[11] Patent Number: 5,143,771

[45] Date of Patent: Sep. 1, 1992

[54] TEXTILE REINFORCEMENT WHICH CAN BE USED TO MAKE VARIOUS COMPOSITES AND METHOD FOR ITS MANUFACTURE

[75] Inventor: André Fourezon, Le Cheylard, France

[73] Assignee: Establissements Les Fils D'Auguste Chomarat et Cie, France

[21] Appl. No.: 521,739

[22] Filed: May 10, 1990

[30] Foreign Application Priority Data

May 19, 1989 [FR] France ..... 89 06828

[51] Int. Cl.[5] ..... B32B 33/00

[52] U.S. Cl. ..... 428/91; 28/107; 28/111; 28/113; 428/225; 428/226; 428/228; 428/234; 428/300; 428/902

[58] Field of Search ..... 428/234, 300, 91, 225, 428/276, 228, 902; 28/107, 111, 113

[56] References Cited

U.S. PATENT DOCUMENTS

| | | | |
|---|---|---|---|
| 2,991,536 | 7/1961 | Moler | 28/107 |
| 3,392,079 | 7/1968 | Fekete | 28/107 |
| 3,479,708 | 5/1969 | Foster | 28/4 |
| 4,555,424 | 11/1985 | Reim et al. | 428/234 |

*Primary Examiner*—James J. Bell
*Attorney, Agent, or Firm*—Wall and Roehrig

[57] ABSTRACT

A unidirectional textile reinforcement fabric for use in laminated articles and a method of making such fabric from conventional warp and weft fabric is shown in which the filament bundles in one of either warp or weft are substantially broken with little or no damage to the other.

6 Claims, 1 Drawing Sheet

TEXTILE REINFORCEMENT WHICH CAN BE USED TO MAKE VARIOUS COMPOSITES AND METHOD FOR ITS MANUFACTURE

The present invention relates to an improvement made to textile reinforcements used to make various composites, such as laminated articles.

It relates more particularly to an improvement made to reinforcements consisting of a glass, carbon etc., thread-based warp and weft fabric.

BACKGROUND OF INVENTION

Among those strengthening structures used when making laminated articles, it has been proposed for many years now to employ nonwovens of fibers, unidirectional sheets, in other words in which the structural filaments are arranged in a same direction, fabrics, bidirectional sheets such as, for example, warp and weft fabrics, or even combinations of such materials.

The present invention relates to an improvement made to bidirectional structures of the warp and weft fabric type.

Warp and weft fabrics have been proposed for many years now as strengthening reinforcements for laminated articles. They have the advantages of being able to be easily manufactured and of providing good mechanical properties both lengthwise and crosswise. For certain applications, however, they have certain disadvantages which result from the fact that the warp and weft threads undulate relative to each other after the weaving operation, when it is frequently desired to have reinforced pieces in which the filaments are arranged as straight and as flat as possible in a same longitudinal direction in order to form a uniform sheet or strip.

Consequently, numerous suggestions have been made for obtaining such sheets, currently referred to by the expression "unidirectional sheets".

Among the solutions, those forming the subject of French Patents 1,394,271 and 1,469,065 may be mentioned.

SUMMARY OF INVENTION

A novel type of material, as well as a production method, have now been found, and this is what forms the subject of the present invention, which not only has improved features as compared with the unidirectional sheets suggested hitherto but may also be made simply and economically using a manufacturing technique enabling high productivity.

In a general manner, the novel strengthening material (unidirectional sheet) according to the invention is in the form of a sheet in which the majority of the basic filaments are arranged in a same direction (longitudinal or transverse) and it is defined in that the securing of said basic filaments is ensured by a fibrous structure which is not only interlaced with the abovementioned unidirectional threads in the manner of a fabric but also comprises fibers which extend partially perpendicularly between two consecutive series of the parallel filaments.

Such a product is obtained by implementing a novel operating process which also forms the subject of the present invention, which process consists in forming a warp and weft fabric from continuous filaments (glass, carbon) in the form of rovings and then in subjecting the fabric thus formed to a needling operation performed under conditions such that the threads of one of the directions of the fabric are separated without damaging the filaments which compose it and that furthermore some of the filaments of the other direction of said fabric are simultaneously broken.

Such a selective penetration of the needles inside the starting fabric is obtained by using a conventional needling technique adapted so as not to damage the bundles of parallel filaments of one of the directions of the starting fabric. In order to do this, according to the invention, needles are used whose barbs are not arranged over the entire periphery of the needle but are oriented parallel to one of the directions of the fabric (warp or weft). These barbs may be arranged either on one generatrix of each needle or symmetrically on either side of the stem of the needle, for example to the rear and to the front of the stem if the feed direction of the starting fabric inside the needle loom is considered.

As a result of such a manner of performing the needling operation, it is possible to separate the filaments forming one of the directions of the fabric without damaging them and, simultaneously, to cause the filaments forming the other direction to be broken and pulled so as to form the fibers which extend over the entire thickness of the fabric.

In the description which follows, the invention will be described with reference to treatment of a unitary woven structure, but it is clear that in this treatment it would also be possible to associate the fabric formed according to the invention with other fibrous structures such as, for example, nonwoven sheets and woven fabrics, only one of the directions (warp and weft) of the support fabric being subjected to the action of the barbs of the needles.

DESCRIPTION OF DRAWING

The invention and the advantages which it brings will, however, be better understood from the exemplary embodiment given hereinbelow as a guide and with no limitation being implied and which is illustrated by the attached figures, in which.

DESCRIPTION OF PREFERRED EMBODIMENTS

Figure 1:
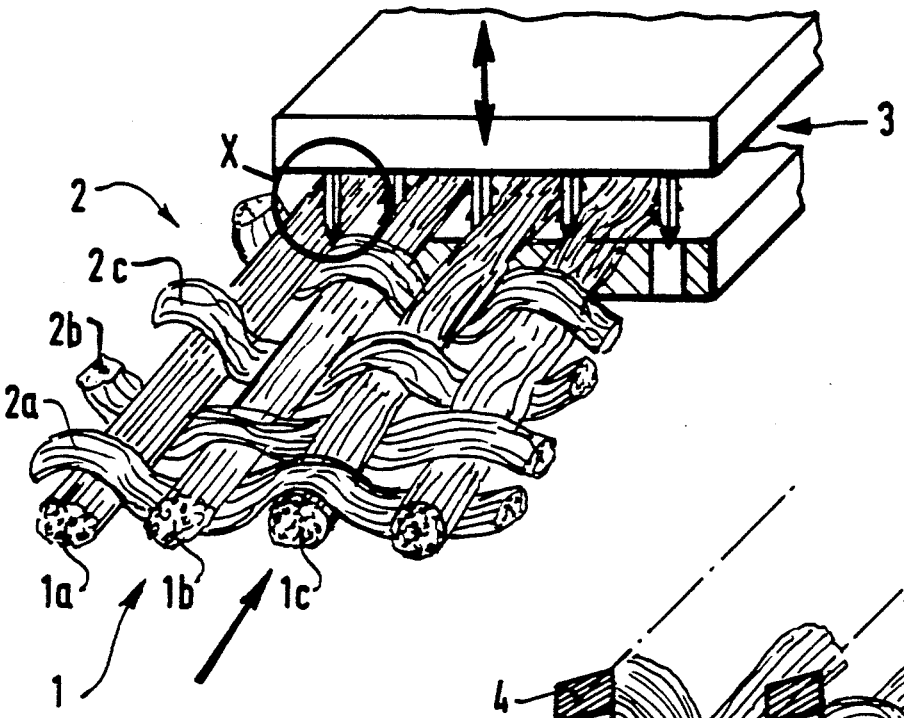
FIG. 1 is a perspective schematic view illustrating the manner in which a warp and weft fabric is treated with a view to obtaining a novel type of strengthening material according to the invention.

Referring to the attached diagrams, the invention therefore relates to an improvement made to the warp and weft fabrics used to strengthen laminated articles, said fabrics being, after treatment according to the invention and in a well-known manner, in the form of a sheet consisting of warp threads (1*a*, 1*b*, 1*c*) interlaced with weft threads (2*a*, 2*b*, 2*c*) and arranged orthogonally relative to each other. In the example illustrated in FIG. 1, the fabric is produced in a conventional armature termed armature "cloth", but it is clear that other types of armatures could also be used.

In the starting fabric, the warp threads designated by the general reference (1) consist of rovings of parallel filaments and are in the form of bundles arranged side by side. The weft threads designated by the general reference (2) also consist of bundles of parallel filaments or (rovings). In the fabric, the weft and warp rovings may either be of the same type or of a different type (for example rovings of glass or carbon threads, of synthetic threads, etc.).

It could, of course, be envisaged to make combinations of different materials, for example alternating glass thread-based rovings and rovings having a different structure (for example carbon).

In accordance with the method according to the invention, the starting fabric is subjected to a needling action by means of a unit (3), which unit consists of a conventional needle loom with needles adapted, according to the process according to the invention, so that when they act upon the fabric, the needles on the one hand cause the separation either of the warp threads or of the weft threads without damaging the filaments and, on the other hand, have an action on the other series of threads (weft threads for example) so as to cause the filaments to break and to give rise to a disorientation so that these filaments implant themselves in the direction of the thickness of the fabric.

Figure 2:
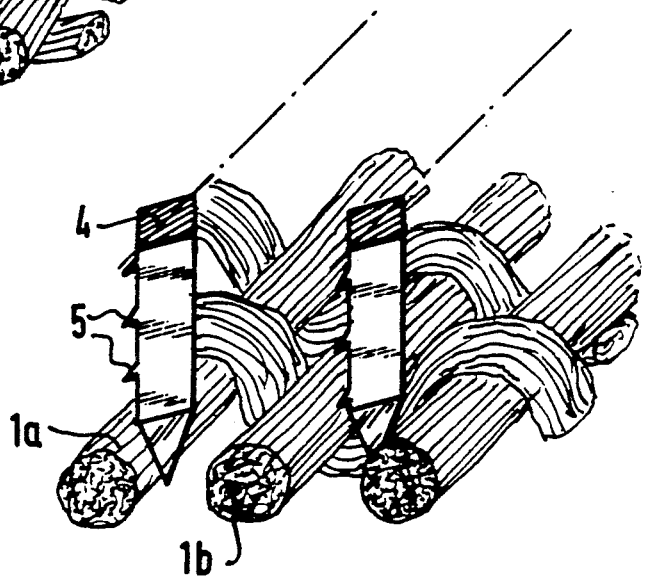
FIG. 2 is a detailed view of the circled part X in FIG. 1 illustrating the action of two consecutive needles on the warp and weft threads of the fabric during its treatment in accordance with the method according to the invention.
Figure 3:
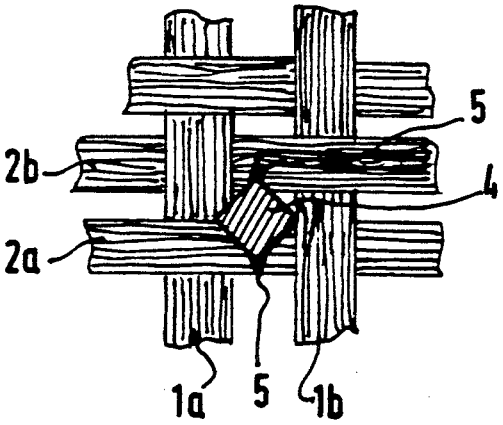
FIG. 3 is a plan view illustrating the manner in which a needle penetrates between the warp and weft threads during a treatment according to the invention.

In order to do this and as is illustrated in FIGS. 2 and 3, needles (4) are used in which the barbs (5) are not arranged over the entire periphery of the stem but are oriented parallel to either the warp or weft rovings. In the present instance, the barbs (5) are presented parallel to the warp threads (see FIGS. 2 and 3). The barbs (5) of the needles may be arranged symmetrically on either side of the stem of the needle or if necessary on only one side, for example at the rear of the stem if the direction of feed of the fabric through the needle loom (3) is considered.

As a result of such a manner of performing the needling operation, a break in the filaments of one of the series of the threads forming the fabric (warp or weft) is therefore caused, the other series (weft or warp) being for its part virtually unaffected by the action of the needles and preserving all its mechanical properties.

As a guide, various comparative tests have been carried out on conventional glass fabrics used to make laminated articles. It was noted that when the fabric was treated by means of a conventional needle loom comprising needles equipped with barbs over their entire periphery, on average an overall loss of strength for both warp and weft of the order of 30 to 35% was obtained, whereas when performing a needling adjusted according to the invention, whether in the warp direction or in the weft direction, the loss of strength in the direction of the fabric not finished by the action of the needles was only of the order of 5 to 10%, whereas in the direction subjected to the action of the needles it was of the order of approximately 70%.

Such a material is particularly advantageous for making laminated articles in which it is desired to have strength properties in a given direction. As compared with the prior unidirectional sheets, the material according to the invention has, surprisingly, the property of facilitating the resin-impregnation operation.

I claim:

1. A textile reinforcement which can be used to make various composites in the form of a sheet in which the majority of the basic filaments are arranged in a same direction, wherein the securing of said basic filaments (*1a, 1b, 1c*) is ensured by a fibrous structure (*2a, 2b, 2c*) which is not only interlaced with the abovementioned unidirectional threads in the manner of a fabric but also comprises fibers which extend partially perpendicularly between two consecutive series of the parallel filaments (*1a, 1b, 1c*).

2. A method of forming a textile reinforcement for making laminated articles in which the strength of the reinforcement is oriented substantially in one direction which comprises:

forming a warp and weft fabric from bundles of continuous filaments;

subjecting said warp and weft fabric to a needling operation to break a portion of the filaments in said bundles in one of said warp or weft directions without damaging the filaments of said bundles disposed in the other direction.

3. The method according to claim 2 wherein said needling operation is caused to break filaments only on one side of the selected warp or weft relative to the direction of feed of said fabric through the needling operation.

4. The method according to claim 3 wherein the breaking of the filaments is performed on the down stream side of the selected warp or weft.

5. The method according to claim 2 including performing the needling operation so as to break sufficient filaments in the selected warp or weft so as to decrease fabric strength in said direction by approximately 70%.

6. The method according to claim 5 including performing the needling operation so as to maintain fabric strength in the undamaged direction at least equal to 90% of the strength before the needling operation.

* * * * *